US006419521B2

(12) United States Patent
Kanagawa et al.

(10) Patent No.: US 6,419,521 B2
(45) Date of Patent: Jul. 16, 2002

(54) SHIELD CONNECTOR

(75) Inventors: Shuichi Kanagawa; Yoshio Mizutani, both of Nagoya (JP)

(73) Assignees: Autonetworks Technologies, Ltd., Nagoya; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/876,131

(22) Filed: Jun. 8, 2001

(30) Foreign Application Priority Data

Jun. 12, 2000 (JP) ..... 2000-175080
Dec. 4, 2000 (JP) ..... 2000-368698

(51) Int. Cl.[7] ..... H01R 9/05
(52) U.S. Cl. ..... 439/582; 439/98
(58) Field of Search ..... 439/582, 585, 439/98, 939

(56) References Cited

U.S. PATENT DOCUMENTS 5,618,190 A * 4/1997 Masuda et al. ..... 439/610
5,645,450 A * 7/1997 Yamada et al. ..... 439/585
5,725,391 A * 3/1998 Masuda et al. ..... 439/582
5,823,824 A * 10/1998 Mitamura et al. ..... 439/585
6,042,396 A * 3/2000 Endo et al. ..... 174/65 R
6,053,749 A 4/2000 Masuda et al. ..... 439/98
6,261,108 B1 * 7/2001 Kanagawa et al. ..... 439/98
6,280,208 B1 * 8/2001 Masuda et al. ..... 174/65 R
6,358,069 B2 * 3/2002 Yoshioka et al. ..... 439/108

* cited by examiner

*Primary Examiner*—Tulsidas Patel
(74) *Attorney, Agent, or Firm*—Oliff & Berridge, PLC

(57) ABSTRACT

A terminal fitting 20 accommodated in a shield connector is formed like a letter L by bending a flat plate portion 22, which extends from a press-attaching portion 21, at a right angle. Even when the flat plate portion 22 has a section, the area of which is equal to that of a section of a connector 11 of a shield wire 10, the flat plate portion 22 can be bent in a direction of width thereof with an allowable bending radius that is small as compared with that of the shield wire 10. Thus, the size of a bent portion is reduced. Consequently, the size of the entire shield connector is decreased.

10 Claims, 8 Drawing Sheets

SHIELD CONNECTOR

BACKGROUND OF THE INVENTION

1. Field of the Invention

The present invention relates to a shield connector provided at an end portion of a shield wire and installed in a through hole, which is formed in a mating shield wall, and to a manufacturing method therefor.

2. Description of the Related Art

An example of such a kind of conventional shield connector printed in JP-A-11-26093 has a straight cylindrical housing 1 that accommodates a rubber ring 2, a holding ring 3, an electrically conductive sleeve 4, and a pressure ring 5, as shown in FIGS. 8 and 9. Further, this shield connector is configured so that a conductive contact piece 6 is disposed on the front outer circumferential surface of the housing 1. Moreover, the housing 1 is attached to the sleeve 4 in such way as to cover an end portion of a shield wire 10. A front-side part, which is farther forward than a flange, of the housing 1 is fitted into a through hole formed in a mating shield wall. Furthermore, apart of the flange is screwed to the mating shield wall by bolts (not shown).

Meanwhile, sometimes, a shield wire should be installed in such a manner as to extend in parallel with the mating shield wall owing to limitations of space. However, the aforementioned conventional shield connector cannot have a structure that enables such installing of shield wires. Conversely, for example, when the cylindrical housing 1 is simply bent like a letter L and further, a shield wire in the housing, the size of the entire shield connector increases due to limitations of an allowable bending radius.

Further, the conventional shield connector has no less than six fundamental components (indicated by the characters 1 to 6). Thus, as is seen from FIG. 9, the conventional shield connector has a very large number of components that include small ones in addition to the six fundamental ones. Therefore, even when the configuration of the conventional shield connector is simply modified, the size thereof increases.

SUMMARY OF THE INVENTION

The invention is accomplished in view of the aforementioned circumstances. Accordingly, an object of the invention is to provide a shield connector enabled to install a shield wire in such a way as to extend in parallel with the mating shield wall, and also enabled to be miniaturized.

To achieve the foregoing object, according to an aspect of the invention, there is provided a shield connector (hereunder referred to as a first shield connector), which is adapted so that a base-side portion of a terminal fitting press-attached to a conductor of a shield wire is accommodated in a housing covering an end portion of the shield wire, and which is provided in a through hole formed in a mating shield wall so that a shield layer of the shield wire is electrically conducted and connected to said mating shield wall, and that a conductor of the shield wire is maintained in a condition where a tip-side portion of the terminal fitting is plunged into the mating shield wall. This shield connector comprises a flat plate portion formed in such a way as to continuously extend from the portion, which is press-attached to the conductor, of the fitting. Further, the entirety of the terminal fitting is L-shaped by bending the flat plate portion. The shield connector further comprises an insulating member that is adapted to cover a part, which extends from the base-side portion to a place near to the tip-side portion, of the terminal fitting, and a shield member that is provided in the housing and adapted to cover an outer surface of the insulating member covering the terminal fitting. In the shield connector, an end of the shield member is continuously connected or electrically conducted to the shield layer of the shield wire, while the other end thereof is disposed at a portion, which abuts against the mating shield wall, of said housing.

In an embodiment (hereunder referred to as a second shield connector) of the first shield connector of the invention, the insulating member covering the terminal fitting is constituted by a heat-contractive insulating tube or by applying a molten insulating resin onto the terminal fitting.

In an embodiment (hereunder referred to as a third shield connector) of the first or second shield connector of the invention, the housing is formed by filling a resin-forming mold, into which the shield wire is inserted, with a synthetic resin.

In an embodiment (hereunder referred to as a fourth shield connector) of the third shield connector of the invention, an electrically conducting flange produced by forming a terminal insertion hole in an electrically conducting member in such a manner as to penetrate therethrough is disposed in the mold together with the shield wire. Moreover, the terminal fitting is inserted into the terminal through hole in such a way as to penetrate therethrough. Furthermore, one of the ends of the shield member is connected to the electrically conducting flange. Further, the housing is formed by the synthetic resin filled in the mold.

According to another aspect of the invention, there is provided a shield connector (hereunder referred to as a fifth shield connector), which is adapted so that a base-side portion of a terminal fitting press-attached to a conductor of a shield wire is accommodated in a housing covering an end portion of the shield wire, and which is provided in a through hole formed in a mating shield wall so that a shield layer of the shield wire is electrically conducted and connected to the mating shield wall, and that a conductor of the shield wire is maintained in a condition where a tip-side portion of the terminal fitting is plunged into the mating shield wall. In this shield connector, the entire terminal fitting is L-shaped by bending a flat plate portion of the fitting in such a way as to continuously extend from the portion, which is press-attached to the conductor, of the fitting in a direction orthogonal to the shield wire. Moreover, apart of the fitting, which extends from the base-side portion to the tip-side portion thereof, is covered with a heat-contractive insulating tube or by applying a molten insulating resin onto the terminal fitting.

The housing is formed like a letter L by an electrically conducting synthetic resin filled in a resin-forming mold, into which the shield wire is inserted, in a state, in which the shield layer is exposed, in such a manner as to be mated with the terminal fitting.

In an embodiment (hereunder referred to as a sixth shield connector) of the fifth shield connector of the invention, a metallic ring is press-attached to the exposed shield layer of the shield wire. Further, a plurality of protruding pieces are provided in the metallic ring in such a way as to project therefrom and extend sidewardly therefrom. Moreover, the housing is formed by filling a space provided around the metallic ring and the plurality of protruding pieces with an electrically conducting synthetic resin.

According to another aspect of the invention, there is provided a shield connector (hereunder referred to as a seventh shield connector), which is adapted so that a base-side portion of a terminal fitting press-attached to a conductor of a shield wire is accommodated in a housing covering an end portion of said shield wire, and which is provided in a through hole formed in a mating shield wall so that a shield layer of the shield wire is electrically conducted and connected to the mating shield wall. This shield connector comprises a plate portion formed in such a way as to continuously extend from a first press-attaching portion, which is press-attached to the conductor, of the fitting. Further, the entirety of the terminal fitting is L-shaped by bending the plate portion. The shield connector further comprises an insulating member with which the terminal fitting is covered, a shield member adapted to cover an outer surface of the insulating member covering the terminal fitting and provided in the housing so that an end of the shield member is continuously connected or electrically conducted to the shield layer of the shield wire, while the other end thereof is disposed at a portion, which abuts against the mating shield wall, of said housing, and a second press-attaching portion, to which an interconnection wire is press-attached. Furthermore, the second press-attaching portion is placed in the housing and provided at an end portion, which is opposite to the first press-attaching portion, of the terminal fitting.

According to an embodiment (hereunder referred to as an eighth shield connector) of the first, second, third, fourth or seventh shield connector of the invention, a fixing member enabled to fix the shield member to the insulating member in a state, in which the shield member is closely attached thereto, is provided on an outside surface of the shield member covering the insulating member.

First Shield Connector

When the housing of the shield connector is attached to the mating shield wall, the terminal fitting press-attached to the conductor of the shield wire is plunged into the shield wall at a side of the housing. In contrast, at the other side of the housing, the shield wire extends in parallel with the mating shield wall. Incidentally, when the flat plate portion has a section, the area of which is equal to that of a section of a connector of a shield wire, the flat plate portion can be bent in a direction of width thereof with an allowable bending radius that is small as compared with that of the shield wire. Thus, the size of a bent portion is reduced. Consequently, the size of the entire shield connector is decreased.

Second Shield Connector

With the configuration of the second shield connector of the invention, the heat-contractive insulating tube is heated and closely attached to and covers the terminal fitting. Alternatively, the molten insulating resin is applied onto the terminal fitting, so that the insulating resin layer covers the terminal fitting. Thus, the terminal fitting and the shield member are electrically insulated from each other by a little space. Consequently, the miniaturization of the shield connector is achieved.

Incidentally, the molten insulating resin is applied onto the terminal fitting by performing, for example, what is called a dipping process of dipping the terminal fitting into the molten insulating resin.

Third Shield Connector

With the configuration of the third shield connector of the invention, the housing is an insert-molded product obtained by inserting the shield wire into the mold. Thus, the number of components of a shield connector is significantly reduced, as compared with the shield connector assembled in the conventional manner. Moreover, when the terminal fitting is covered with the heat-contractive insulating tube or with the insulating resin layer before insert-molding is performed, the shield member from touching the terminal fitting at a resin pressure at the time of press-molding.

Fourth Shield Connector

With the configuration of the fourth shield connector of the invention, the shield layer of the shield wire is electrically conducted and connected to the mating shield wall through the conducting flange and the shield member connected thereto when the electrically conducting flange is pressed against the opening edge of the through hole formed in the mating shield wall.

Fifth Shield Connector

With the configuration of the fifth shield connector, the housing is an insert-molded product obtained by inserting the shield wire into the mold. Thus, the fifth shield connector of the invention has the effect that the number of components is significantly reduced, in addition to the effects of the first shield connector. Moreover, the housing is formed from the electrically conducting resin layer and closely attached to the shield layer. Thus, the entire housing also serves as a shield member for covering the terminal fitting. Consequently, the number of components is reduced still more. Moreover, the miniaturization of the shield connector is achieved. Furthermore, because the terminal fitting is covered with the insulating tube or the insulating resin layer, the terminal fitting is reliably insulated from the housing.

Sixth Shield Connector

With the configuration of the sixth shield connector, the metallic ring is press-attached onto the shield layer. Thus, the ring and the shield layer are stably conducted and connected to each other. Further, in the sixth shield connector, a plurality of protruding pieces are provided on the metallic ring in such a way as to project therefrom. Thus, the contact area between the ring and the housing is large. Consequently, the ring and the housing are stably conducted and connected to each other. Consequently, the electrically conducting housing and the shield layer of the shield wire are stably conducted and connected to each other.

Seventh Shield Connector

When the housing of the seventh shield connector of the invention is attached to the mating shield wall, the interconnection wire press-attached to the second press-attaching portion of the terminal fitting is inserted into the shield wall at one end side of the housing. The shield wire press-attached to the first press-attaching portion extends inparallel with the mating shield wall. Incidentally, although the terminal fitting has the plate portion, which connects both the press-attaching portions to each other and is L-shaped, the plate portion can be bent in a direction of width thereof with an allowable bending radius that is small as compared with that of the shield wire, even in the case that the plate portion has a section, the area of which is equal to that of the conductor of the shield wire. Thus, the size of a bent portion is reduced. Consequently, the size of the entire shield connector is decreased.

Moreover, the interconnection wire inserted into the mating shield wall can be freely provided. For example, the interconnection wire can be bent like a letter "L" and extended in a direction parallel to the mating shield wall. This results in increase in flexibility in setting the position of a connection part, which is connected to the tip-side portion of the interconnection wire, in the mating shield. Consequently, the space required in the mating shield wall can be reduced.

Eighth Shield Connector

According to the eighth shield connector of the invention, the fixing member can fix the shield member to the insulating member in a state, in which the shield member is closely attached thereto. Consequently, the shield member can be prevented as much as possible from interfering with another member and being deformed and damaged when the shield member is manufactured.

DETAILED DESCRIPTION OF THE PREFERRED EMBODIMENTS

Now, a description will be given in more detail of preferred embodiments of the invention with reference to the accompanying drawings.

First Embodiment

Figure 1:
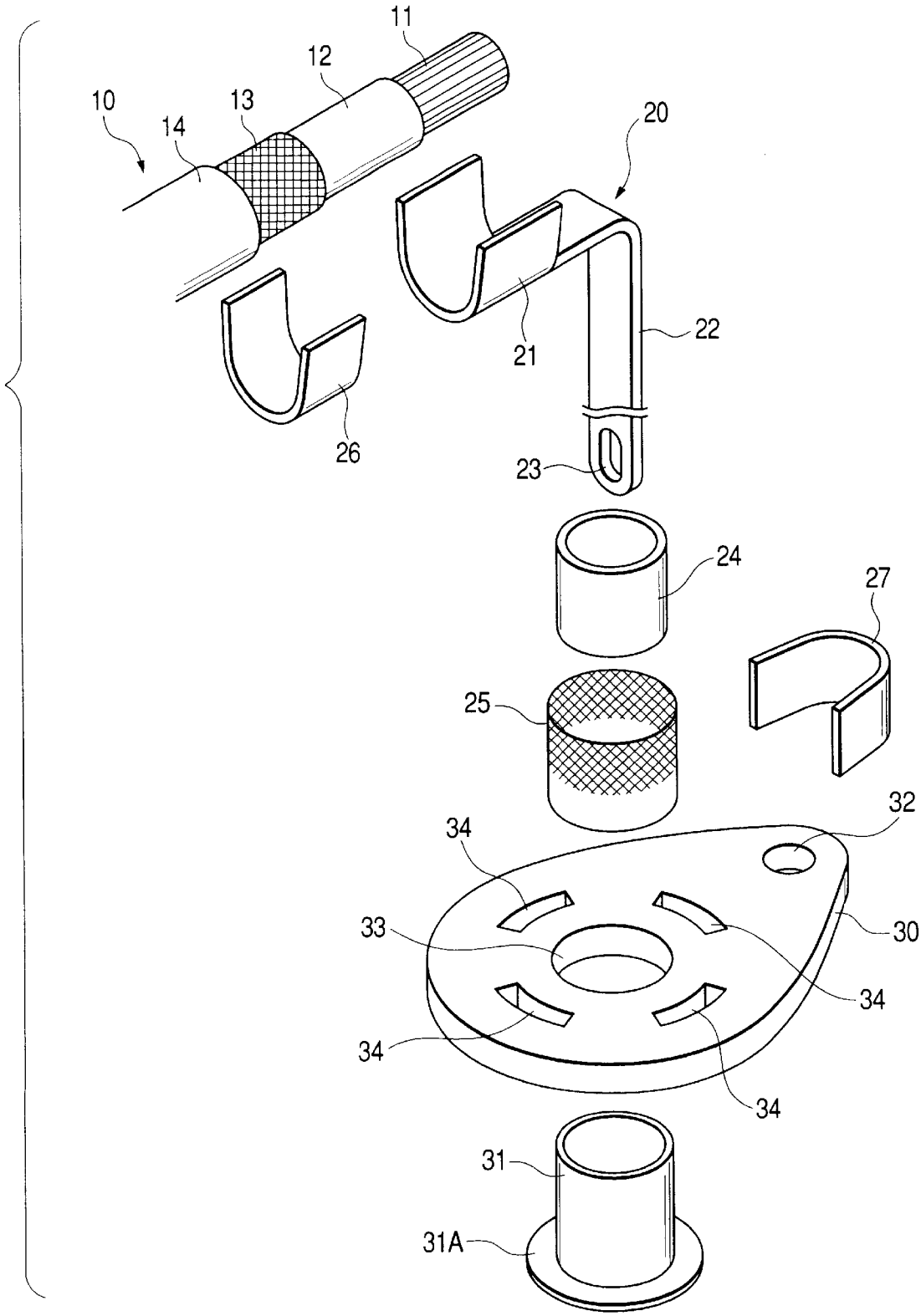
FIG. 1 is an exploded perspective view of parts of a shield connector that is a first embodiment of the invention.

Next, a first embodiment of the invention is described hereinbelow with reference to FIGS. 1 to 4. As shown in FIG. 1, a shield wire 10 has a conductor 11, an inner insulating layer 12, a shield layer 13, and an external sheath 14, so that the conductor 11 is surrounded by the insulating layer 12, the shield layer 13, and the external sheath 14 in this order from an axial core. Further, in an end portion of the shield wire 10, the conductor 11, the inner insulating layer 12, and the shield layer 13 are sequentially exposed in a circumferentially stepped manner from a tip end thereof.

Figure 2:
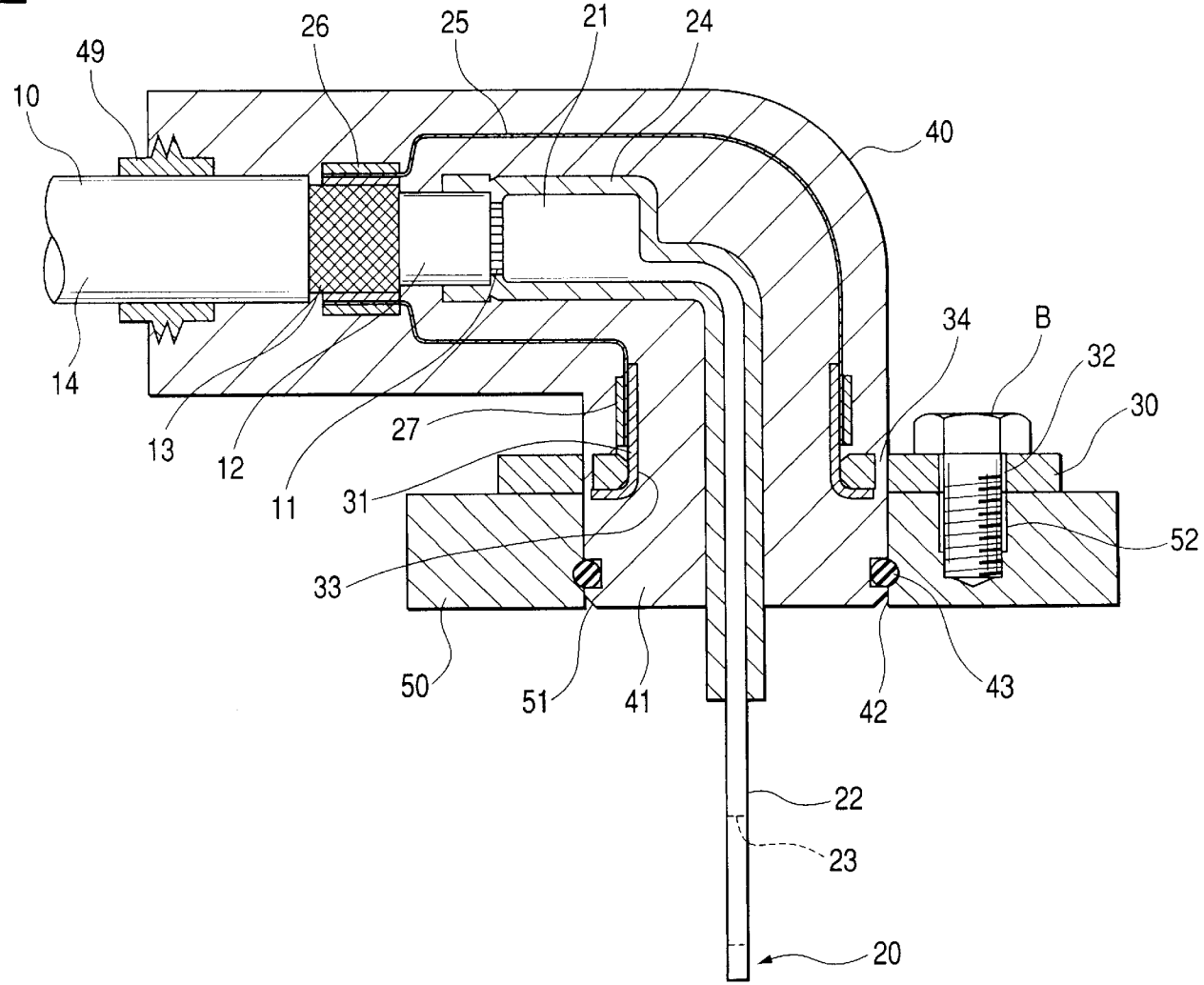
FIG. 2 is a side sectional view of the shield connector.
Figure 3:
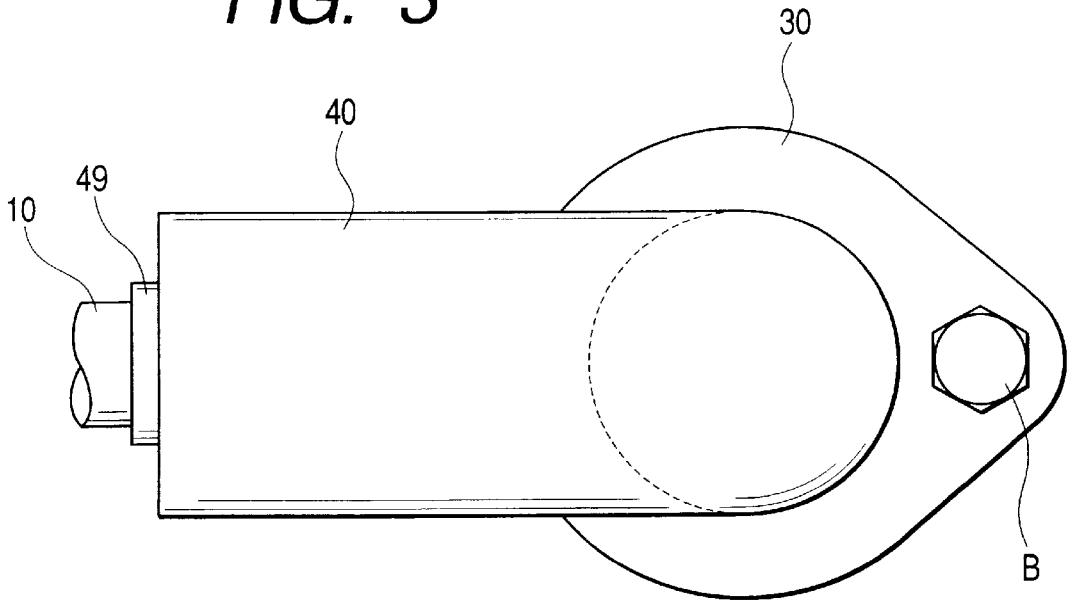
FIG. 3 is a plan view of the shield connector.
Figure 4:
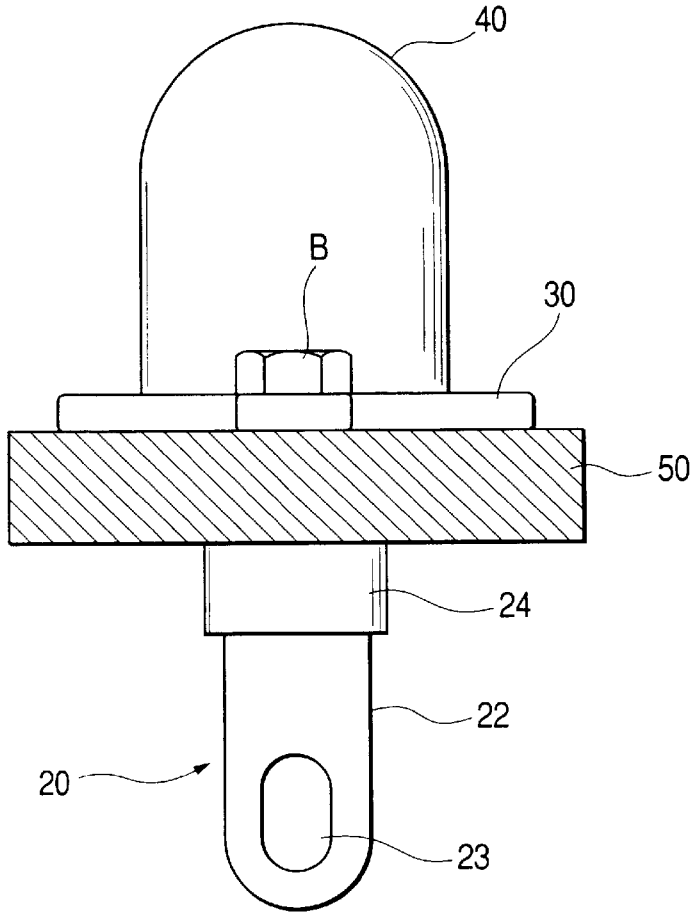
FIG. 4 is a front view of the shield connector.

FIG. 2 shows the shape of a section of the shield connector of this embodiment. This shield connector is integrally attached to the end portion of the shied wire 10. In this figure, reference numeral 20 designates a terminal fitting that has a press-attaching portion 21 obtained by bending a metallic plate like a letter U. Further, an elongated flat plate 22 is provided in such a manner as to extend from an end of the bottom wall of the press-attaching portion 21. Furthermore, the flat plate portion 22 is bent at a middle part thereof at a right angle toward a direction orthogonal to the shield wire 10 (that is, downwardly, as viewed in FIG. 2). The side surface of the entire terminal fitting 20 is L-shaped, as shown in FIG. 2. Further, an elongated hole 23 is formed in an end part of the flat plate portion 22, as illustrated in FIG. 1. The outward shape of the end part of the flat plate portion is roundish correspondingly to the arcuate shape of a side portion end of the elongated hole 23.

Apart of the terminal fitting 20, which extends from the base-side portion to a certain middle portion thereof, is covered with a heat-contractive insulating tube 24. The insulating tube 24 passes through a space provided outside the terminal fitting 20 in a state in which the terminal fitting 20 is press-attached to the conductor 11. Further, the connector is put into a state in which an end portion of the insulating tube 24 covers the tip end of the inner insulating layer 12 of the shield wire 10, and in which the other end portion thereof is placed at a middle part of the flat plate portion 22 and contracted by being heated. Consequently, as illustrated in FIG. 2, the insulating tube 24 is closely attached to the end portion of the inner insulating layer 12 and the terminal fitting 20.

The outside surface of the insulating tube 24 is covered with a shield member 25 constituted by a cylindrical braid. An end portion of the shield member 25 is put upon the outer surface of the shield layer 13. A press-attaching piece 26 (see FIG. 1) obtained by bending a metallic plate like a letter U is then put sideways and press-attached on the end portion of the shield member 25. Thus, the shield member 25 is fixed in a state in which the end portion thereof is electrically conducted and connected to the shield layer 13. Further, the other end portion of the shield member 25 is disposed in such a way as to cover the outer surface of an electrically conducting sleeve 31 (to be described next) provided in the conducting flange 30. Moreover, a press-attaching piece 27 (see FIG. 1) obtained by bending a metallic plate like a letter U are put sideways and press-attached on this end portion of the shield member 25. Thus, the shield member 25 is fixed in a state in which this end portion thereof is electrically conducted and connected to the conducting flange 30.

The conducting flange 30 is constituted by a metallic plate, and shaped like a pear by sideways projecting and tapering off a part of the edge of this disk. Then, a bolt insertion hole 32 is formed in the tapered end portion thereof, while a terminal insertion hole 33 is formed in the central portion of the disk. Further, four resin inflow holes 34 are formed at places, at which the peripheral portion of the terminal insertion hole 33 is quadrisected. Further, as shown in FIG. 1, reference character 31 designates a metallic sleeve. A part of this cylinder is crushed and forced out sideways in such a manner as to form a brim-like portion 31A. As illustrated in FIG. 2, the sleeve 31 is pressed into the terminal insertion hole 33 from the end portion thereof opposite to the brim-like portion 31A.

As shown in FIG. 2, an end portion of the external sheath 14 of the shield wire 10 is covered with a waterproof tube portion 49, which is formed like a tube by inserting the shield wire 10 into a mold for resin-molding, so that the outside surface of the external sheath 14 is covered with a resin filled into the mold. Furthermore, the waterproof tube portion 49 is made of a synthetic resin (for instance, urethane), which is softer than the resin that constitutes a housing 40 (to be described next).

Meanwhile, the end portion of the shield wire 10 is covered with the housing 40 made of a synthetic resin. More particularly, the housing 40 is formed by inserting the shield wire 10 into the mold for resin-molding, and by then putting an insulating synthetic resin (for instance, polyamide) into a molten state and filling the mold with the synthetic resin. At that time, an end part of the flat portion 22 of the terminal fitting 20 press-attached to the shield wire 10 is set in such a manner as to be inserted into the terminal insertion hole 10. The molten resin is filled into the mold from the side of the end part of the flat plate portion 22. Thus, the molten resin gets into the space provided between the insulating tube 24 and the shield member 25 in the housing 40 through the terminal insertion hole 33 of the conducting flange 30, while the molten resin flows into the space provided outside the shield member 25 in the housing 40 through the resin inflow holes 34 formed around the terminal insertion hole 33. Then, the housing 40 is formed like a letter L along the terminal fitting 20. The conducting flange 30 is fixed at a certain middle point on a side of the "L". Further, a part, which extends from the side of the conducting flange 30 to the side of the end of the flat plate portion 22, of the housing 40 constitutes a cylindrical fitting portion 41. The flat plate portion 22 is erected on the end surface of the fitting portion 41. Moreover, an O-ring groove 42 is formed in the outer circumferential surface part of the fitting portion 41. Furthermore, an O-ring 43 is accommodated in this O-ring groove 42.

The shield connector according to this embodiment, which is configured as described above, is attached to a shield wall (hereunder referred to as a "mating shield wall") 50 of, for example, an external wall of a motor. As illustrated in FIG. 2, a through hole 51 is formed in this mating shield wall 50. Further, a screw hole 52 is formed in the vicinity of the through hole 51. Moreover, the shield connector is fixed to the mating shield wall 50 by fitting the fitting portion 41 into the through hole 51 and then pushing the conducting flange 30 against the opening edge thereof and screwing a bolt B, which is inserted into the bolt insertion hole 32, into a screw hole 52. Then, the terminal fitting 20 press-attached to the conductor 11 of the shield wire 10 is plunged into the mating shield wall 50 at the side of the end portion of the housing 40. Furthermore, the conducting flange 30 is closely attached to the mating shield wall 50. The shield layer 13 of the shield wire 10 is electrically conducted and connected to the mating shield wall 25. Further, at the side of the other end portion of the housing 40, the shield wire 10 is brought into a state in which the wire 10 extends in parallel with the mating shield wall 50. Incidentally, the terminal fitting 20 is L-shaped by bending the flat plate portion 22, which extends from the press-attached portion 21, at a right angle. Thus, even when the flat plate portion 22 has a section, the area of which is equal to that of a section of the connector 11 of the shield wire 10, the flat plate portion 22 can be bent in a direction of width thereof with an allowable bending radius that is small as compared with that of the shield wire 10. Thus, the size of the bent portion is reduced. Consequently, the size of the entire shield connector is decreased.

Thus, in the case of the shield connector according to this embodiment, the shield wire 10 can be installed in such a manner as to extend in parallel with the mating shield wall 50. Moreover, the miniaturization of the shield connector is achieved. Furthermore, the insert-molded product obtained by inserting the shield wire 10 into the mold is employed as the housing 40. Thus, the number of components of a shield connector is significantly reduced, as compared with the shield connector assembled in the conventional manner. Moreover, the terminal fitting 20 is covered with the heat-contractive insulating tube 24. Thus, there is no fear that the shield member 25 may touch the terminal fitting 20 at a resin pressure at the time of press-molding of the housing 40. Additionally, because the insulating tube 24 is heat-contractive, the tube 24 is closely attached to the terminal fitting 20 and accommodated in a small space.

Second Embodiment

Figure 5:
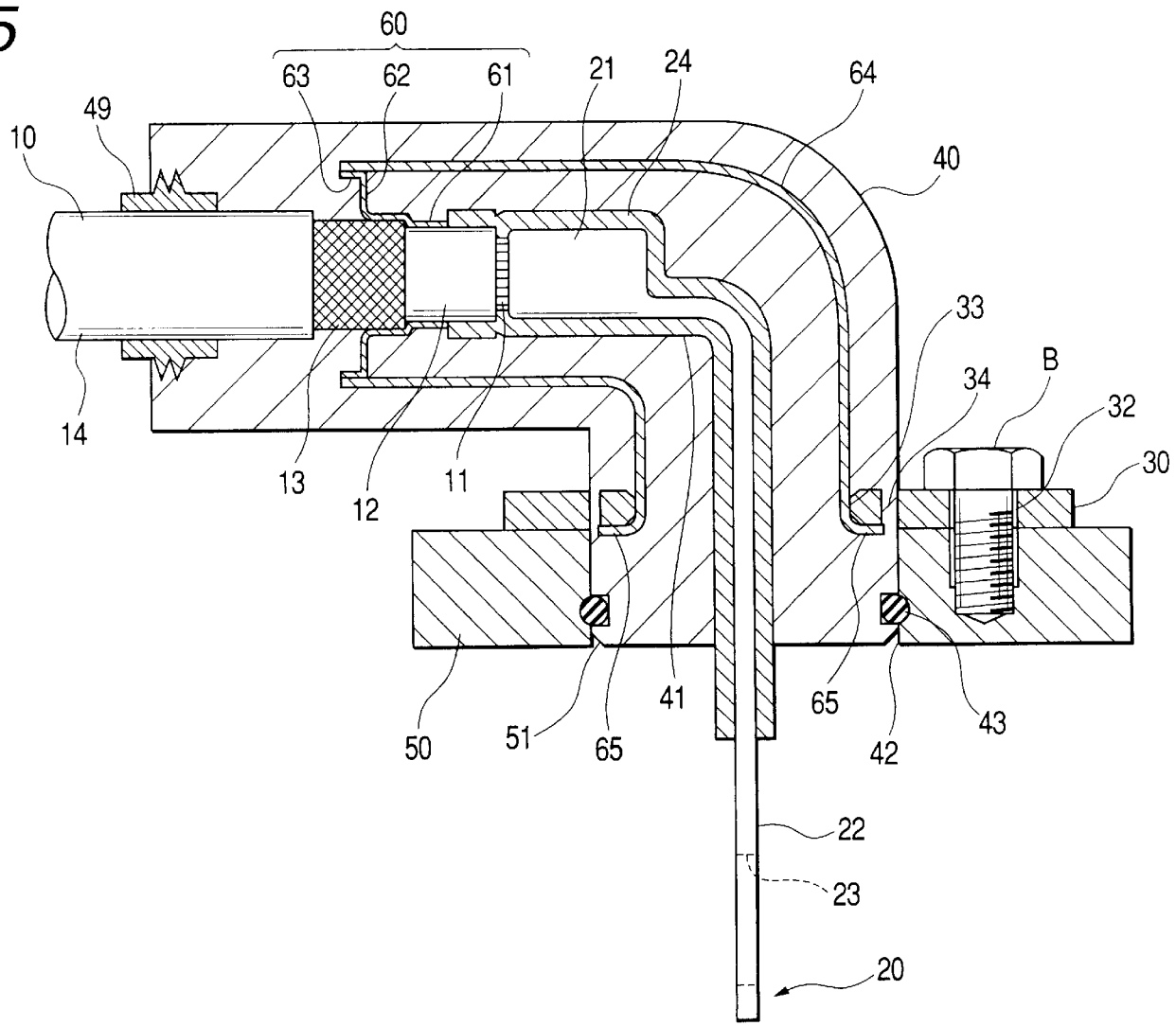
FIG. 5 is a side sectional view of a shield connector that is a second embodiment of the invention.

FIG. 5 shows a shield connector that is this embodiment of the invention. Hereinafter, only the difference in configuration between the first and second embodiments of the invention. In this figure, each of constituent elements, which are the same as the elements of the fist embodiment, respectively, is designated by the same reference character as that indicating the same constituent element of the first embodiment of the invention. Thus, the redundant description of such constituent elements is omitted herein.

The conducting sleeve 60 is fitted into the space provided outside the shield layer 13 of the shield wire 10. The conducting sleeve 60 has a structure in which a flange 62 projects sideways from an end portion of a cylindrical element 61, and in which a large-diameter cylindrical portion 63 is formed by performing what is called a beam drawing process so that an outer edge portion of the flange 62 extends in parallel with a direction of an axis of the cylindrical element 61. Further, the cylindrical element 61 is swaged so that the element 61 and the shield layer 13 are tightly and closely attached to each other.

In FIG. 5, reference numeral 64 denotes a shield member formed by bending a metallic pipe like a letter L. A plurality of strip portions 65 are provided in an end portion of the shield member 64 by forming, for example, a plurality of cutouts (not shown) extending along an axial direction of the cylindrical element 61 therein. Then, the end portion of the shield member 64 is press-fitted into the terminal insertion hole 33. Subsequently, such strip portions 65 are outwardly bent in such a manner as to be erected on the shield member 64. Furthermore, the large-diameter cylindrical portion 63 of the conducting sleeve 60 is closely fitted into the shield member 64 by inserting the shield wire 10 thereinto from the opposite opening of the conducting flange 30 and from the side of the terminal fitting 20.

With such a configuration, the shield wire 10 can be installed by attaching the shield connector to the mating shield wall 50 so that the shield wire 10 extends in parallel with the wall 50. Moreover, reduction in the number of components of and the miniaturization of the shield connector are achieved.

Third Embodiment

Figure 6:
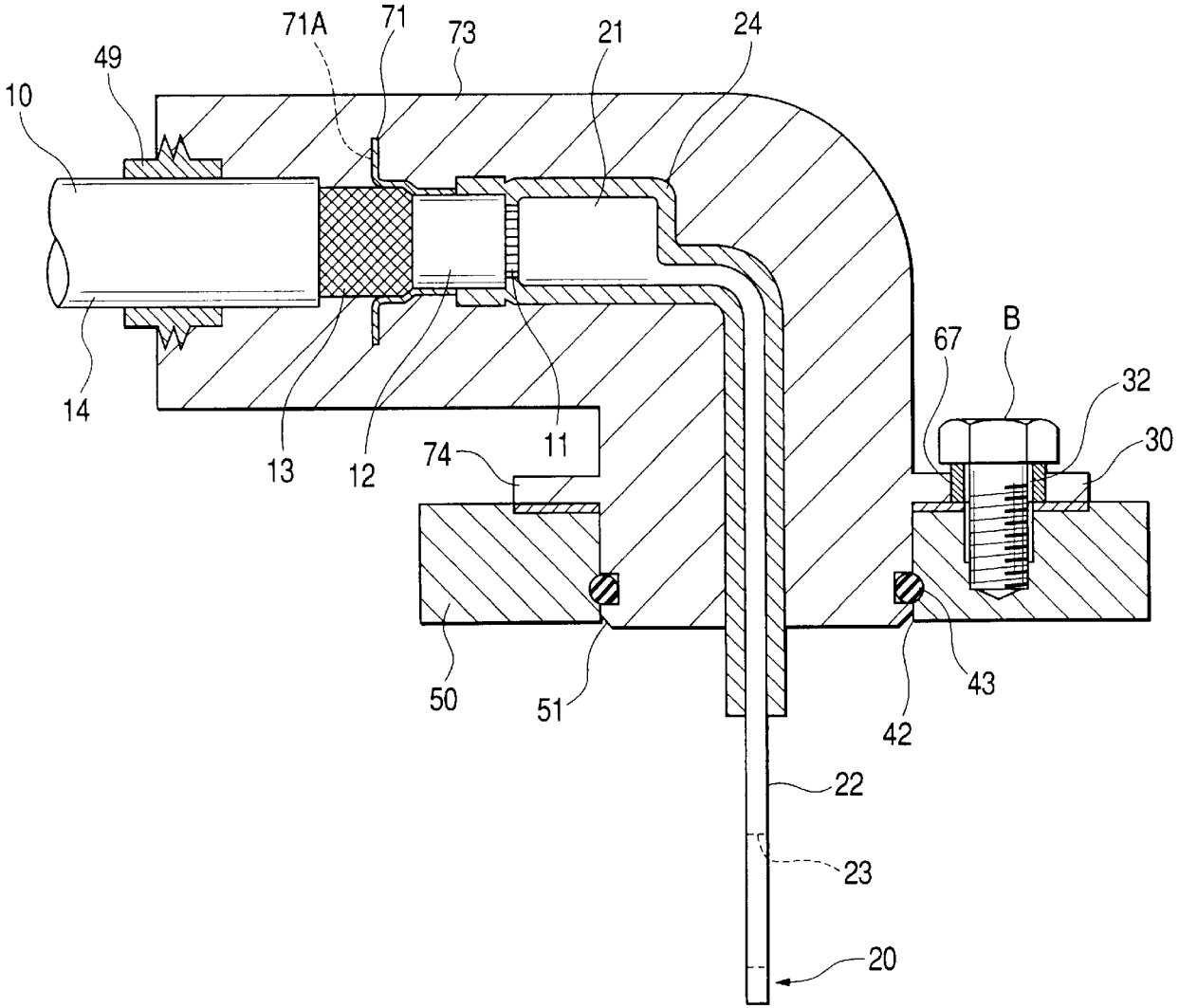
FIG. 6 is a side sectional view of a shield connector that is a third embodiment of the invention.

FIG. 6 shows the shield connector according to this embodiment. Hereinafter, only the difference in configuration between the third embodiment and each of the first and second embodiments of the invention. In this figure, each of constituent elements, which are the same as the elements of the fist embodiment, respectively, is designated by the same reference character as that indicating the same constituent element of the first embodiment. Thus, the redundant description of such constituent elements is omitted herein.

As shown in FIG. 6, a metallic ring 70 is attached to the shield layer 13 of the shield wire 10. Furthermore, a protruding pieces 71 are formed in such a way as to sideways project from an end portion of the metallic ring 70. Additionally, a hole 71A is formed in each of the protruding pieces 71 in such a manner as to penetrate therethrough. Further, the metallic ring 70 is press-attached to the shield layer 13 and stably conducted and connected thereto and embedded in a housing 73 (to be described next).

In the third embodiment, the housing 73 is made of an electrically conducting synthetic resin. More concretely, the housing 73 is formed like a letter L by an electrically conducting synthetic resin filled in a resin-forming mold, into which the shield wire 10 is inserted, in a state, in which the shield layer 13 is exposed and further the metallic ring 70 is press-attached thereto, in such a manner as to be mated with the terminal fitting 20. Moreover, the flange 74 to be pushed against the mating Shield wall 50 is formed in such a way as to be integral with the housing 73.

Thus, in the case of the shield connector according to the third embodiment, the housing 70 is made of the conducting synthetic resin and closely attached to the shield layer 13 of the shield wire 10. Thus, the entire housing 70 serves as the shield member covering the terminal fitting 20. Consequently, further reduction in the number of components and the stabilization of the shield connector are achieved. Moreover, the metallic ring 70 is press-attached to the shield layer 13, so that the ring 70 and the layer 13 are stably conducted and connected to each other. Furthermore, the plurality of protruding pieces 71 are formed in such a way as to extend from the metallic ring 70, so that the metallic ring 70 is in contact with the large area of the housing 73 made of the conducting synthetic resin, and that the ring 70 and the housing 73 are stably conducted and connected to each other. Consequently, the conducting housing 73 and the shield layer 13 of the shield wire 10 are stably conducted and connected to each other through the metallic ring 70.

Fourth Embodiment

Figure 7:
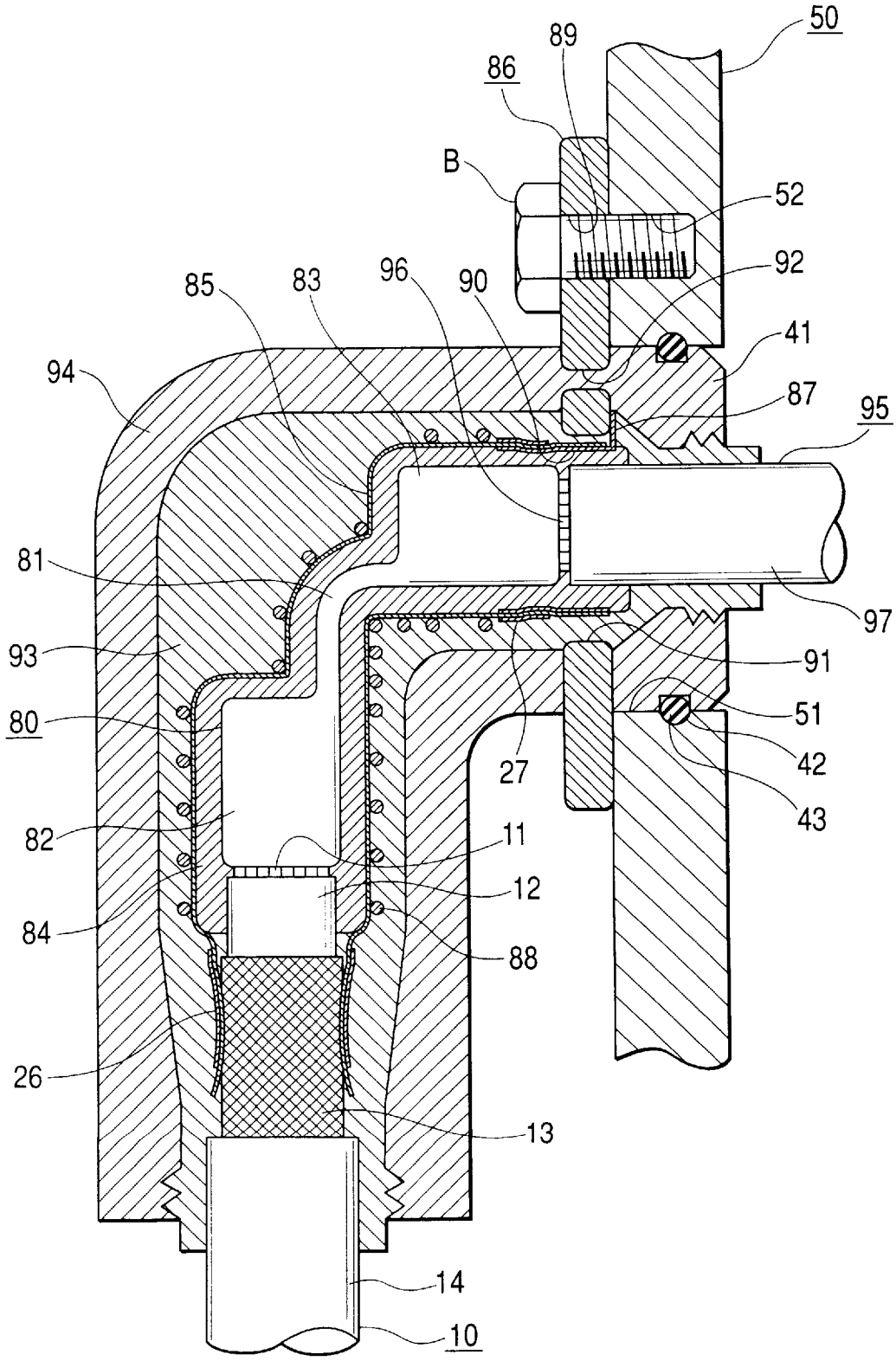
FIG. 7 is a side sectional view of a shield connector that is a fourth embodiment of the invention.
Figure 8:
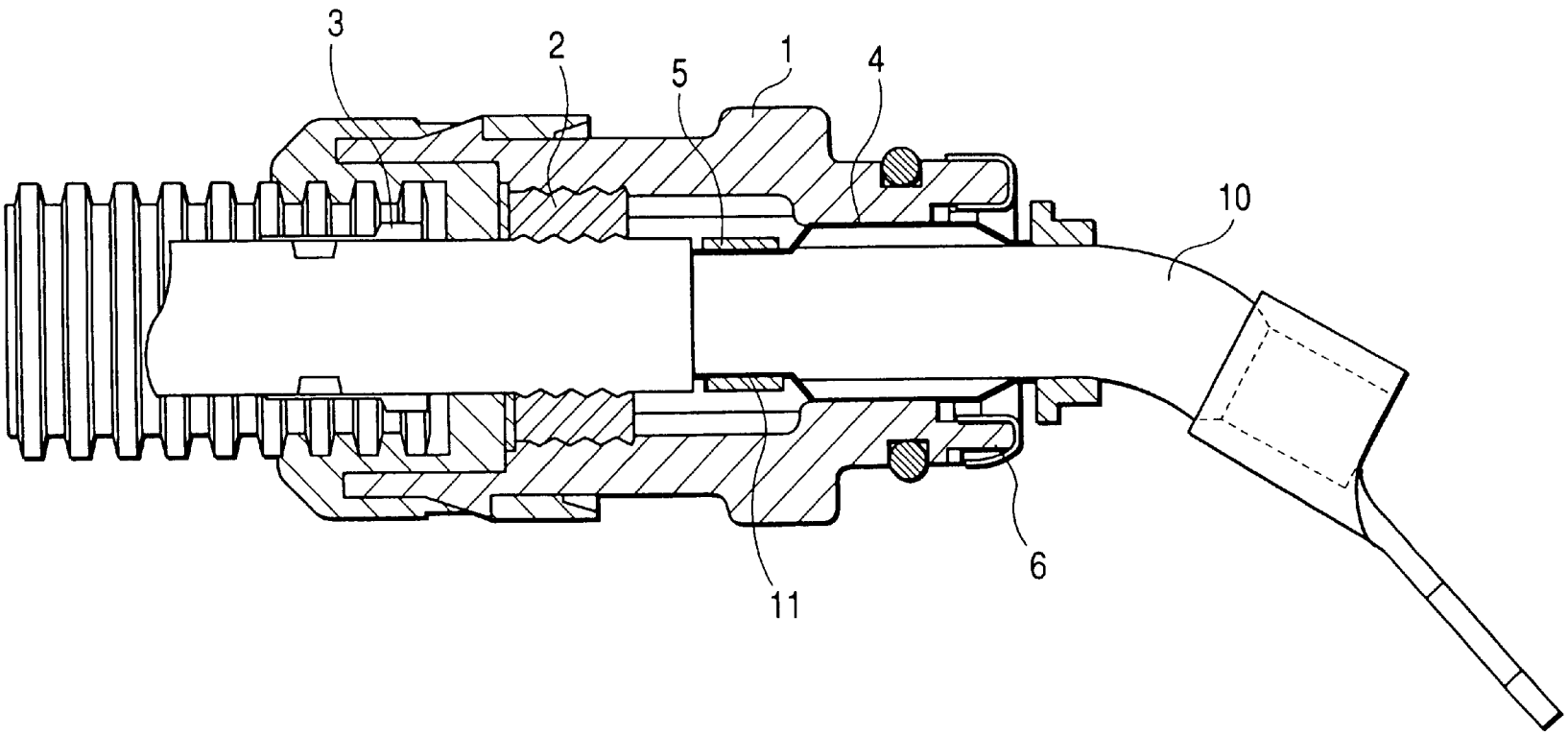
FIG. 8 CONVENTIONAL ART
FIG. 8 a side sectional view of a conventional shield connector.
Figure 9:
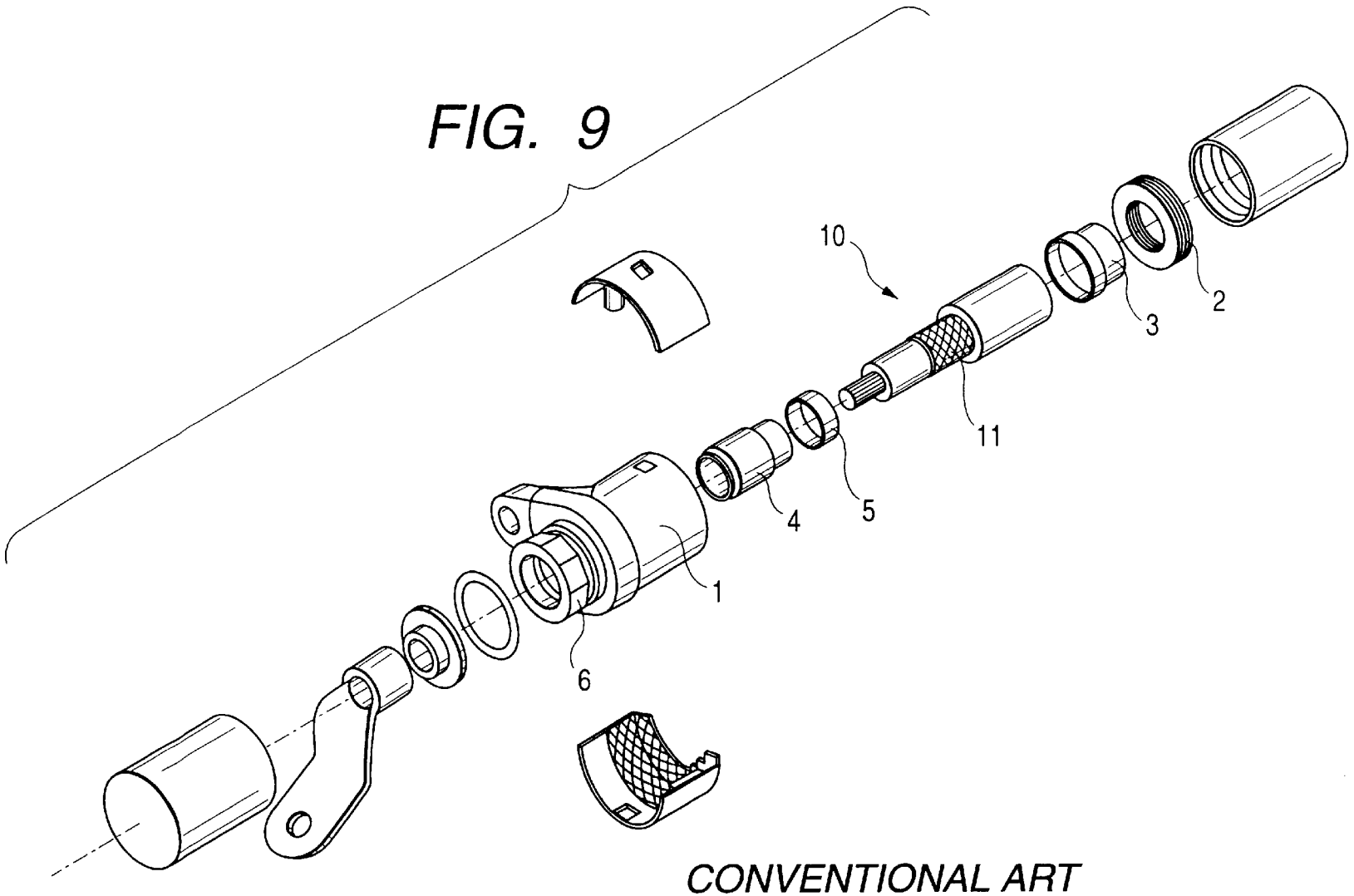
FIG. 9 is an exploded perspective view of the conventional shield connector.

Further, a fourth embodiment of the invention is described hereinbelow with reference to FIG. 7. Incidentally, in the following description, only the difference in configuration between the first and fourth embodiments is described. Additionally, like reference characters designate constituent elements of the fourth embodiment, which are the same as those of the first embodiment, in this figure. Thus, the redundant description of such constituent elements is omitted herein.

A terminal fitting 80 has a first press-attaching portion 82 and a second press-attaching portion 83, which are provided at both ends of a plate portion 81 formed like a letter "L" by bending a metallic plate at a right angle from some midpoint thereon and which are formed by being bent like a letter "U". A conductor 11 of a shield wire 10 is press-attached to the first press-attaching portion 82, while a conductor 96 of an interconnection wire 95 constituted by covering the conductor 96 with an insulating coating 97 is press-attached to the second press-attaching portion 83. This terminal fitting 80 is covered with a heat-contractive insulating tube 84 in a state in which both the wires 10 and 95 are press-attached thereto. The insulating tube 84 is closely attached onto the entire region, which extends from an end portion of an inner insulating layer 12 of the shield wire 10 to an end portion of the insulating coating 97 of the interconnection wire 95 through the terminal fitting 80, by heating and then contracting this insulating tube 84.

The outside surface of the insulating tube 84 is covered with a shield member 85, which is constituted by a cylindrical braid, in a state in which the shield member 85 is closely attached onto the outside surface of the tube 84. A U-shaped pre-attaching piece 26 is externally press-attached to an end portion of the shield member 85 in a state in which the end portion of the member 85 is put upon the outer surface of a shield layer 13 of the shield wire 10. A U-shaped pre-attaching piece 27 is externally press-attached to the other end portion of the shield member 85 in a state in which this end portion of the member 85 is put upon a conductive sleeve 87 that is fitted into a terminal insertion hole 90 of an electrically conductive flange 86. Thus, the shield member 85 is electrically conducted and connected to the shield layer 13 and the conductive sleeve 87. Further, a fixing member constituted by, for instance, a copper wire is wound around the outside surface of the shield member 85. Consequently, the shield member 85 is fixed to the insulating tube 84 in such a way as to be closely attached thereto.

The conducting flange 86 is constituted by a metallic plate, and the outward form thereof is shaped like a pear, as is seen from FIG. 1. Then, a bolt insertion hole 89 and a terminal insertion hole 90 are formed in the conductive flange 86 in such a way as to penetrate therethrough. Moreover, a plurality of first resin inflow holes are formed in the conductive flange 86 by partly cutting out a hole edge portion of the terminal insertion hole 90 in such a manner as to penetrate through the conductive flange 86. A plurality of second resin inflow holes 92 are formed in the conductive flange 86 at positions, each of which is shifted outwardly and radially by a predetermined dimension and circumferentially by a predetermined angle from the position of a corresponding one of the first resin inflow holes 91, in such a way to penetrate through the conductive flange 86.

The end portions of the shield wire 10 and the interconnection wire 95, which are connected by the terminal fitting 80 to each other, are covered with a seal cylinder 93 that is covered with a housing 94. Particularly, the seal cylinder 93 is formed by inserting the shield wire 10 and the interconnection wire 95 into a mold for primary molding and then putting an insulating synthetic resin (for example, urethane), which is softer than the resin that constitutes a housing 94, into a molten state and subsequently filling the mold with the molten insulating synthetic resin. At that time, the molten synthetic resin spreads before and behind the conductive flange 86 through the first resin inflow holes 91 formed therein. During this process, the shield member 85 is fixed to the insulating tube 84 by the fixing member 88 in such a manner as to be closely attached thereto. Thus, the shield member 85 is prevented as much as possible from being deformed and damaged owing to the injection pressure of the synthetic resin filled in the mold. The seal cylinder 93 is shaped like a letter "L" along the terminal fitting 80 and covers the entire insulating tube 84 and the entire shield member 85. Further, the seal cylinder 93 is formed in a region that extends from an end portion of an external sheath 14 of the shield wire 10 to an end of the insulating coating 97 of the interconnection wire 95. This seal cylinder 93 fluid-tightly maintains portions provided around the shield wire 10 and the interconnection wire 95. On the other hand, the housing 94 is formed by inserting the seal cylinder 93, which is formed in the aforementioned manner, into a mold for secondary molding and then putting an insulating synthetic rein (for example, polyamide) into a molten state and subsequently filling the mold with this molten insulating synthetic resin. At that time, the molten synthetic resin spreads before and behind the conductive flange 86 through the second resin inflow holes 92 formed therein. Further, the housing 94 is formed like a letter "L" along the seal cylinder, and the conductive flange 86 is fixed to one side of the L-shaped housing 94 at some midpoint thereon.

The shield connector of this embodiment, which is constituted as described above, is attached to the mating shield wall 50. When the shield connector is attached thereto, first, a fitting portion 41 of the housing 94 is fitted into a through hole 51 while the interconnection wire 95 rightwardly drawn out of the housing 94, as viewed in the figure, is inserted into the mating shield wall 50 from the tip-side (that is, the side corresponding to an end portion opposite to the end portion press-attached to the second press-attaching portion 83) through the through hole 51. The shield connector is fixed to the mating shield wall 50 by screwing a bolt B, which penetrates through the bolt insertion hole 89, into a screw hole 52 during the conductive flange 86 is pressed against the opening edge of the through hole 51. At that time, outside the shield wall 50, the shield wire 10 drawn from the housing 94 extends in parallel with the shield wall 50. On the other hand, the interconnection wire 95 inserted into the mating shield wall 50 can be provided in such a way as to extend in an arbitrary direction in the mating shield wall 50. Therefore, for example, the connection wire 95 can be bent like a letter "L", and made to extend in a direction parallel to the mating shield wall 50. Thus, a connecting part (not shown) of equipment, to which the tip-side portion of the interconnection wire 95 is connected, can be provided at an arbitrary position in the mating shield wall 50. Consequently, the saving in space in the mating shield wall is achieved.

Other Embodiments

The invention is not limited to the aforementioned embodiments. For example, the following embodiments are included in the technical scope of the invention. Moreover, various modifications can be made without departing from the gist of the invention.

(1) Although the housing is an insert-molded product obtained by inserting the shield wire 10 into the mold in each of the embodiments, the housing may be preliminarily formed and the shield wire may be incorporated into the housing when the connector is assembled. More practically, the following modification may be employed. That is, a cylindrical housing bent like a letter L is divided into two housing portions extending in a longitudinal direction. Subsequently, an L-shaped terminal fitting is press-attached to the shield wire. Thereafter, the shield connector is assembled by accommodating the shield wire in such a manner as to be sandwiched between the two housing portions.

(2) Although the shield member 25 constituted by the braid is connected to the shield layer 13 in the first embodiment, the shield member 25 may be replaced with an elongated shield layer 13 of the shield wire 10.

(3) Further, the first embodiment may be modified by covering the outer surface of the shield member 25, which is constituted by the braid, with a heat-contractive insulating tube and then contracting the tube. Thus, the shield connector can be made to be compact by sandwiching the shield member 25 between this insulating tube and the insulating tube 24 provided on the outer surface of the terminal fitting 20.

(4) Although the terminal fitting is covered with the heat contractive insulating tube 24 in each of the embodiments, for example, the molten insulating rein may be applied to a predetermined part of the terminal fitting.

(5) Although the first and second embodiments are described in the case that a predetermined distance between the shield member and the insulating tube that covers the terminal fitting is secured, the shield member may be attached to the insulating tube in such a way as to be closely attached thereto and maybe externally fixed thereto by the fixing means, such as a copper wire, similarly as in the case of the fourth embodiment, in the case where there is a fear that the shield member is deformed and damaged owing to the pressure of the molten synthetic resin to be filled in the mold.

What is claimed is:

1. A shield connector, adapted so that a base-side portion of a terminal fitting press-attached to a conductor of a shield wire is accommodated in a housing covering an end portion of said shield wire, and which is provided in a through hole formed in a mating shield wall so that a shield layer of said shield wire is electrically connected to said mating shield wall, and that a conductor of said shield wire is maintained in a condition where a tip-side portion of said terminal fitting is plunged into said mating shield wall, said shield connector comprising:

a flat plate portion formed in such a way as to continuously extend from said portion, which is press-attached to said conductor, of said fitting, the entirety of said terminal fitting being L-shaped by bending said flat plate portion;

an insulating member, adapted to cover a part, which extend from said base-side portion to near said tip-side portion, of said terminal fitting; and a shield member, provided in said housing and adapted to cover an outer surface of said insulating member covering said terminal fitting, wherein an end of said shield member is electrically connected to said shield layer of said shield wire, while the other end thereof is disposed at a portion, which abuts against said mating shield wall, of said housing.

2. The shield connector according to claim 1, wherein said insulating member covering said terminal fitting is constituted by a heat-contractive insulating tube or by applying a molten insulating resin onto said terminal fitting.

3. The shield connector according to claim 1, wherein said housing is formed by filling a resin-forming mold, into which said shield wire is inserted, with a synthetic resin.

4. The shield connector according to claim 3, wherein an electrically conducting flange produced by forming a terminal insertion hole in an electrically conducting member to penetrate therethrough is disposed in said mold together with said shield wire, wherein said terminal fitting is inserted into said terminal through hole to penetrate therethrough, wherein one of said ends of said shield member is connected to said electrically conducting flange, and wherein said housing is formed by said synthetic resin filled in said mold.

5. A shield connector, adapted so that a base-side portion of a terminal fitting press-attached to a conductor of a shield wire is accommodated in a housing covering an end portion of said shield wire, and which is provided in a through hole formed in a mating shield wall so that a shield layer of said shield wire is electrically connected to said mating shield wall, and that a conductor of said shield wire is maintained in a condition where a tip-side portion of said terminal fitting is plunged into said mating shield wall, said shield connector comprising:

a flat plate portion provided in said fitting so that the entirety of said terminal fitting is L-shaped by bending said flat plate portion to continuously extend from said portion, which is press-attached to said conductor, of said fitting in a direction orthogonal to said shield wire, a part, which extends from said base-side portion to said tip-side portion thereof and is provided in said fitting and extends from said base-side portion to said tip-side portion thereof, is covered with a heat-contractive insulating tube or by applying a molten insulating resin onto said terminal fitting, and wherein said housing is L-formed by an electrically conducting synthetic resin filled in a resin-forming mold, into which said shield wire is inserted, in a state, in which said shield layer is exposed, to be mated with said terminal fitting.

6. The shield connector according to claim 5, wherein a metallic ring is press-attached to said exposed shield layer of said shield wire, wherein a plurality of protruding pieces are provided in said metallic ring to project therefrom and extend sidewardly therefrom, and wherein said housing is formed by filling a space provided around said metallic ring and said plurality of protruding pieces with an electrically conducting synthetic resin.

7. A shield connector, adapted so that a base-side portion of a terminal fitting press-attached to a conductor of a shield wire is accommodated in a housing covering an end portion of said shield wire, and which is provided in a through hole formed in a mating shield wall so that a shield layer of said shield wire is electrically connected to said mating shield wall, said shield connector comprising:

a plate portion formed in such a way as to continuously extend from a first press-attaching portion, which is press-attached to said conductor, of said fitting, the entirety of said terminal fitting being L-shaped by bending said plate portion;

an insulating member with which said terminal fitting is covered;

a shield member adapted to cover an outer surface of said insulating member covering said terminal fitting and provided in said housing so that an end of said shield member is electrically connected to said shield layer of said shield wire, while the other end thereof is disposed at a portion, which abuts against said mating shield wall, of said housing; and a second press-attaching portion, to which an interconnection wire is press-attached, said second press-attaching portion being placed in said housing and provided at an end portion, which is opposite to said first press-attaching portion, of said terminal fitting.

8. The shield connector according to claim 1, wherein a fixing member enabled to fix said shield member to said insulating member in a state, in which said shield member is closely attached thereto, is provided on an outer surface of said shield member covering said insulating member.

9. The shield connector according to claim 2, wherein said housing is formed by filling a resin-forming mold, into which said shield wire is inserted, with a synthetic resin.

10. The shield connector according to claim 7, wherein a fixing member enabled to fix said shield member to said insulating member in a state, in which said shield member is closely attached thereto, is provided on an outer surface of said shield member covering said insulating member.

* * * * *